US005588765A

United States Patent [19]

Campbell

[11] Patent Number: 5,588,765

[45] Date of Patent: Dec. 31, 1996

[54] APPARATUS FOR ANALYZING SIGNATURES

[75] Inventor: Robert K. Campbell, Anaheim, Calif.

[73] Assignee: Signa Scan, Inc., Anaheim, Calif.

[21] Appl. No.: 358,008

[22] Filed: Dec. 16, 1994

Related U.S. Application Data

[62] Division of Ser. No. 98,582, Jul. 28, 1993, abandoned.

[51] Int. Cl.[6] ..... B43K 7/00; B43K 7/10

[52] U.S. Cl. ..... 401/216; 401/209; 401/220

[58] Field of Search ..... 401/216, 220, 401/209

[56] References Cited

U.S. PATENT DOCUMENTS

| | | | |
|---|---|---|---|
| 2,511,561 | 6/1950 | Beumer | 401/216 X |
| 3,047,901 | 8/1962 | Hubbard | 401/216 X |
| 4,717,277 | 1/1988 | Hutt | 401/220 X |

FOREIGN PATENT DOCUMENTS

| | | | |
|---|---|---|---|
| 976131 | 3/1951 | France | 401/216 |

*Primary Examiner*—Steven A. Bratlie
*Attorney, Agent, or Firm*—Hawes, Fischer & Dickinson

[57] ABSTRACT

An apparatus and method to enable investigators of medical and insurance fraud to quickly and reliably determine whether a plurality of signatures affixed to a series of documents were made with the same pen and/or at the same time. According to a first embodiment, a series of indentations are formed around the periphery of the rim at the forward end of a conventional ballpoint pen. The indentations produce radially inward extending projections which are aligned with the rolling ball of the pen to induce scratches or micro-striations in the ink lines applied to the paper from the ball. By analyzing the scratch patterns of different signatures applied by the same maker to different documents, an indication can be provided whether the signatures were all made with the same pen.

2 Claims, 1 Drawing Sheet

APPARATUS FOR ANALYZING SIGNATURES

This is a division of application Ser. No. 08/098,582 filed Jul. 28, 1993 now abandoned.

BACKGROUND OF THE INVENTION

1. Field of the Invention

This invention relates to an apparatus and method to enable investigators to quickly and reliably determine whether a plurality of signatures were all made with the same ballpoint pen and/or at the same time. The present invention is particularly applicable to investigations that are intended to combat medical or insurance fraud.

2. Background Art

Multiple signing is the act of signing one's name many times during one office visit. This act may constitute a fraud if it was otherwise intended that the signatures should have been made at different times. By way of example, a patient who is supposed to undergo treatment requiring different office visits over a period of time may actually make only a single visit and execute a series of medical documents as if a number of visits were made. The patient or doctor may then submit claims to an insurance company seeking reimbursement for a program of treatment that was never offered or completed. Of late, this problem has become widespread with the resulting significant cost being borne by insurance companies, government agencies and consumers, alike.

Combating such fraudulent activities is difficult, because the signatures that are applied to the different documents are genuine. That is to say, even if the signatures are closely examined, there is normally no tell-tale sign which is indicative of the dates on which the documents were executed and the pen or pens used to make the signatures. Therefore, there is no quick and reliable way to determine whether the patient signed the documents at the same or different times.

SUMMARY OF THE INVENTION

In general terms, an apparatus and method are disclosed by which investigators may make an accurate determination whether a plurality of signatures affixed to different documents were made at the same or different times and/or with the same or different pens. With regard to the apparatus, the forward end or rim of a conventional ballpoint pen is modified to highlight the subtle nuances which are characteristic of one's writing habits. More particularly, a series of small indentations are formed around the periphery of the rim of the pen. The indentations produce radially inward extending projections which are positioned relative to the rolling ink ball to wipe off a small portion of the ink that is applied to the paper from the ball. Therefore, the ink lines deposited on the paper will contain small scratches or micro-striations. The micro-striations will track the movement of the pen over the paper and not the rotation of the ball. Thus, if the maker rotates the pen in his hand or changes the angle of the pen relative to the paper, the location of the micro-striations will undergo a corresponding change. By enlarging and comparing the signatures side-by-side one another (e.g. with the aid of a video camera), the respective scratch patterns of the signatures can be analyzed for the purpose of determining whether the same pen was used to make all of the signatures and whether the pen was rotated in the maker's hand.

With regard to the method, a fluorescent tracer compound that oxidizes in air is added to the ink that is applied to the paper from a conventional ballpoint pen, or the like. After the signature is made, the original tracer compound in the ink will begin to oxidize into a new compound that fluoresces under ultraviolet light at a different color compared with the color at which the original tracer compound will fluoresce. By knowing the rate of oxidation of the tracer compound and the respective magnitudes of the fluorescence emitted by the original and new compounds, the elapsed time between the execution of two signatures can be calculated by measuring the magnitude of certain colors of fluorescent light emitted by the ink from the signatures for determining and then comparing the amount of tracer compound that has been oxidized in each signature.

DETAILED DESCRIPTION

Figure 1:
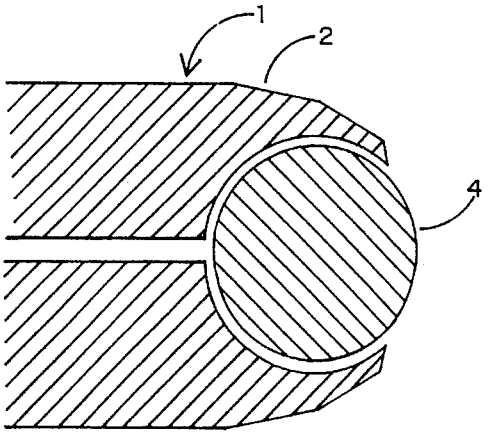
FIG. 1 (PRIOR ART)
FIG. 1 is a cross-section of the forward end of a conventional ballpoint pen.
Figure 2:
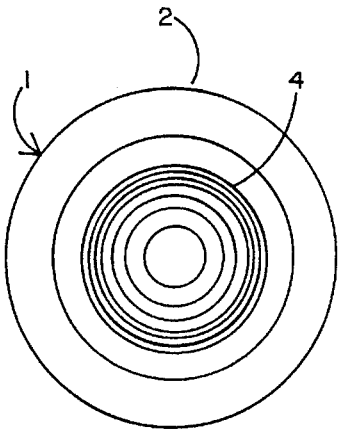
FIG. 2 (PRIOR ART)
FIG. 2 is an end view of the conventional ballpoint pen of FIG. 1.

FIGS. 1 and 2 of the drawings show a conventional ballpoint pen 1. As is well known, the ballpoint pen 1 includes a generally cylindrical plastic or metal body 2 which secures a rolling ball 4 at the forward end thereof. Thus, the ball 4 is adapted to rotate in the usual fashion to apply ink from the body 2 to a writing surface, such as a piece of paper, or the like.

Figure 3:
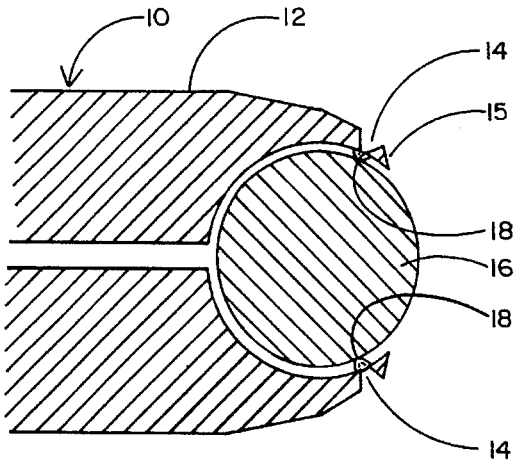
FIG. 3 is a cross-section of the forward end of a ballpoint pen that has been modified in accordance with one embodiment of the present invention.
Figure 4:
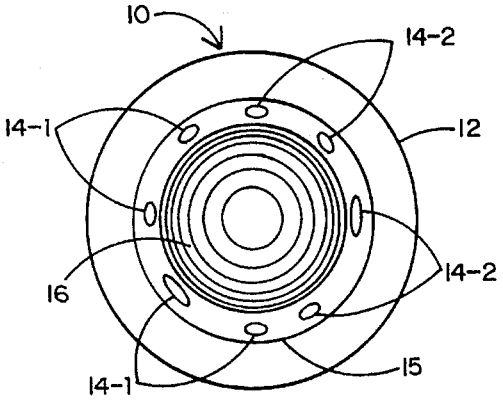
FIG. 4 is an end view of the modified ballpoint pen of FIG. 3.

Referring now to FIGS. 3 and 4 of the drawings, a conventional ballpoint pen 10 is shown having modifications made thereto in accordance with one embodiment of the present invention. More particularly, a series of small indentations, notches or grooves 14 are formed around the forward end or rim 15 of the pen body 12 which surrounds and supports the ball 16 for rotation. The indentations 14 may be oval or round and may be equally or randomly spaced from one another around the periphery of the rim 15. It is to be understood that the particular shape and spacing of the indentations 14 are not to be considered a limitation of the present invention, although it is preferred that the sizes of and spacing between adjacent indentations 14-1 located at one side of the pen body 12 be different from the sizes and spacings of the indentations 14-2 located at the opposite side.

The formation of indentations 14 correspondingly causes metal to flow radially inward from the rim 15 of pen body 12 toward the ball 16 so as to create respective projections 18. The projections 18 are aligned with ball 16 so as not to impede the rotation thereof but to be close enough to wipe off a portion of the ink that is carried by the ball for application to the writing paper (not shown). That is to say, the normal flow of ink between the pen 10 and the paper will be interrupted (i.e. wiped away) only by the projections 18 created by the formation of indentations 14.

For example, if the pen 10 were moving from right to left, only those projections 18 formed by indentations 14-1 at the left side of the pen body 12 will wipe ink from the ball 16, and the remaining projections will have no effect on ink flow. As a result of the foregoing, the ink will be applied to the paper as relatively thin lines (designated 20 and 30 in FIGS. 5 and 6) having one or more scratches or micro-striations introduced thereto by the projections 18. The micro-striations are generally microscopic variations in the density of the ink which will occur across the width of any ink line made by the modified ballpoint pen 10. However, it may be appreciated that the micro-striations track the movement of the pen body 12 and not the rotation of the ball 16.

Figure 5:
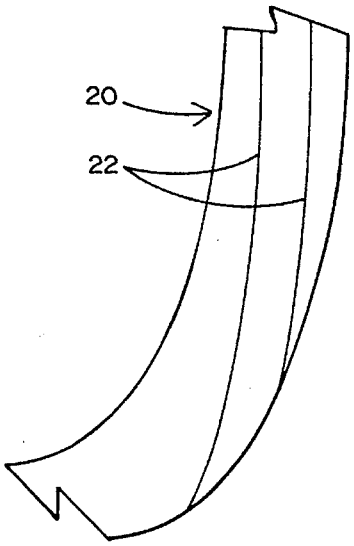
FIGS. 5 and 6 show the respective scratch patterns formed by making ink lines with the modified ballpoint pen of FIGS. 3 and 4.
Figure 6:
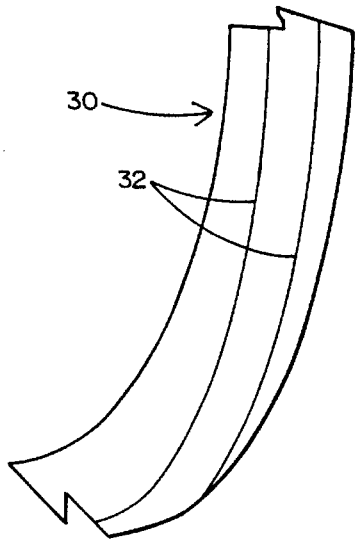

FIGS. 5 and 6 of the drawings show the ink lines 20 and 30, respectively, that are deposited on a writing surface (e.g. paper) when using the ballpoint pen 10 illustrated at FIGS. 3 and 4 to make a downstroke. More particularly, the ink line 20 from the downstroke of FIG. 5 will be produced when the pen 10 is held steady in the hand of the writer. The ink line 30 from the downstroke of FIG. 6 will be produced when the pen 10 is turned clockwise in the writer's hand. Thus, the corresponding micro-striations 22 which appear in the ink line 20 will be generally linear, while the micro-striations 32 which appear in the ink line 30 will be generally curved in the direction of pen rotation. Accordingly, although the ink lines 20 and 30 may appear to be identical in and of themselves, the micro-striations 22 and 32 appearing therein can be distinguished from one another so as to indicate whether the same pen was used to make such lines.

In this regard, the scratch patterns of the ink lines 20 and 30 may be magnified and analyzed, because the micro-striations are sensitive to both the angle at which the pen is held and the rotation applied to the pen by the hand of the maker. That is, and as previously explained, as the writing angle of the pen changes, the micro-striations 22 and 32 will move across the width of the lines 20 and 30. The foregoing analysis may be accomplished with the aid of a video camera for making a side-by-side caparison of the lines. Therefore, if the ink lines 20 and 30 were parts of signatures, a comparison of the ink lines would enable a determination to be made whether the signatures were executed with the same pen and whether the pen was rotated during the signing process. That is, the direction (i.e. angle) of and spacing between the micro-striations of the scratch pattern in a signature would be characteristic of a particular pen (e.g. 10) held by a particular maker at a particular writing angle.

In the case of medical record keeping, if the same signature appeared at different places on a stack of documents and all of the signatures had identical scratch patterns, an indication would therefore be provided that the signatures were written with the same pen and, most likely, at the same time. Thus, an investigator would be alerted to possible fraud if the documents bore different dates of execution.

In accordance with another embodiment of the present invention, a method is now disclosed by which to give investigators the ability to reliably determine whether different signatures were made at the same or different times. Like the modified ballpoint pen 10 of FIGS. 3 and 4 which introduces particular patterns of micro-striations into the ink lines 20 and 30 at FIGS. 5 and 6, the method to be described below includes the step of introducing a tell-tale date indicator to the ink that is applied to a writing surface by any conventional pen, such as the ballpoint pen 1 illustrated at FIGS. 1 and 2.

More particularly, a time dated tracer is added to the ink. The tracer is adapted to undergo a chemical change to cause the ink to undergo a predictable color change with time. Therefore, and in the case of medical record keeping, if a plurality of signatures made with an identical ink were characterized by identical colors, an indication would therefore be provided that the signatures were made at substantially the same time. Thus, an investigator would be alerted to possible fraud if the documents on which the signatures appeared bore widely different dates of execution.

It is preferable that the tracer added to the ink be a fluorescent chemical compound which oxidizes when exposed to air so as to form a new chemical compound that will fluoresce under ultraviolet light at a different color than the color at which the original compound will fluoresce when initially deposited on the writing surface. In this regard, it is desirable that the ink to which the fluorescent tracer is added have a high carbon or similar base that will not fluoresce. Different fluorescent tracers may be added to the ink depending upon the rate of oxidation desired and the corresponding speed at which the ink will change color. By way of example only, a fluorescent tracer that will oxidize slowly in air and cause a correspondingly slow change in the color of the ink to which it is added is that known commercially as Congo Red. A fluorescent tracer that will oxidize rapidly and cause a correspondingly rapid color change is ferrous citrate. Ferrous sulphate is a fluorescent tracer having an intermediate rate of oxidation and ability to cause a color change to the ink. Similarly, it may be desirable to add several tracers to the ink having different, but predictable, rates of oxidation and effects on color.

By knowing the rate of oxidation of the particular fluorescent tracer and the respective magnitudes of the colors at which the original and new chemical compounds will fluoresce over time, the elapsed time between the execution of two signatures can be calculated. That is, the magnitude of certain colors of fluorescent light emitted by the ink of each signature is measured for indicating how much the original tracers have oxidized since deposition on the writing surfaces. The foregoing may be accomplished by means of a conventional optical filter and a photodetector that is responsive to the magnitude of a particular color of fluorescent light emitted by the ink of the signatures. Comparing the percentage of oxidation of the known tracer in the ink of one signature with the percentage of oxidation of the known tracer in the ink of another signature will indicate whether the signatures were made at the same time as well as the approximate date when each signature was made.

By virtue of the present method, a relatively quick and accurate determination can be made whether a patient executed a series of documents at the same time. The disclosed method may be advantageously used where a single pen is employed to make a number of signatures, such as when the pen is fixedly attached to a sign-in clipboard or nurses station. The disclosed method may also be used even if different pens are employed to make the signatures provided that the fluorescent tracer in the ink of each signature is known.

It will be apparent that while the preferred embodiments of the invention have been shown and described, various modifications and changes may be made without departing from the true spirit and scope of the invention. For example, it may be highly advantageous to include the tell-tale ink having the time dated tracer as disclosed herein in the modified pen illustrated at FIGS. 3 and 4 of the drawings. In this regard, investigators will have a reliable means for determining both the execution dates and the identity of the pen or pens used for making a plurality of signatures on different medical or insurance related documents.

Having thus set forth the preferred embodiments, what is claimed is:

1. A ballpoint pen having a supply of ink and comprising a rolling ball retained within a rim at the forward end of the pen for applying the supply of ink to a writing surface and a plurality of indentations formed around the rim of said pen to produce a corresponding plurality of projections extending radially inward of said rim and aligned with said rolling ball to interrupt some of the supply of ink being applied by said rolling ball to the writing surface to thereby cause micro-striations to appear in each ink line applied to the writing surface, the distance between at least some of said plurality of indentations formed in said rim being greater than the distance between at least some other of said plurality of indentations such that the number of micro-striations in an ink line and the distance between the micro-striations in the ink line are indicative of whether the ink line was deposited by said ballpoint pen.

2. The ballpoint pen recited in claim 1, wherein at least one of said plurality of indentations is larger than at least one other of said plurality of indentations.

* * * * *